United States Patent [19]

Ling

[11] Patent Number: 4,852,372

[45] Date of Patent: Aug. 1, 1989

[54] RANDOMLY ENGAGEABLE COMBINATION LOCKING DEVICE

[76] Inventor: Chong-Kuan Ling, P.O. Box 53-58, Taipei, Taiwan

[21] Appl. No.: 282,691

[22] Filed: Dec. 12, 1988

[51] Int. Cl.[4] ..... E05B 37/02

[52] U.S. Cl. ..... 70/312; 70/74

[58] Field of Search ..... 70/69, 70, 71, 72, 73, 70/74, 75, 76, 312

[56] References Cited

U.S. PATENT DOCUMENTS

| | | | |
|---|---|---|---|
| 3,452,563 | 7/1969 | Atkinson | 70/312 |
| 3,584,906 | 6/1971 | Budzyn | 70/76 |
| 3,597,945 | 8/1971 | Feinberg | 70/74 |
| 4,100,775 | 7/1978 | Bako | 7/3 |
| 4,155,234 | 5/1979 | Bako | 70/312 |
| 4,324,120 | 4/1982 | Gisiger | 70/312 |
| 4,548,059 | 10/1985 | Ruegg | 70/75 |
| 4,771,617 | 9/1988 | Dueringer | 70/74 |

*Primary Examiner*—Robert L. Wolfe

[57] ABSTRACT

A combination locking device includes a lower base portion secured on a luggage case, and an upper cover pivotally secured to a luggage cover securable on the luggage case, the upper cover having a hasp operatively fastened by a latch tongue resiliently retained in the lower base portion formed with combination dials and sleeves therein so that when the dials in the lower base portion are rotated to their opening combination and a slide member is depressed inwardly to disengage the latch tongue from the hasp member, the upper cover can be opened from the lower base portion in a quick way.

14 Claims, 5 Drawing Sheets

RANDOMLY ENGAGEABLE COMBINATION LOCKING DEVICE

BACKGROUND OF THE INVENTION

Boleslaw Ludwig Budzyn disclosed a draw bolt in his U.S. Pat. No. 3,584,906 for luggage, containers, receptacles, or the like cooperable with a hasp serving as a lock for fastening two relative members of the luggage or container. However, such a draw bolt has the following drawbacks:

1. When it is intended to open the lock, a key should be provided to open the key barrel 74 to disengage the locking bolt 78 from the blocking means 82. Since the key is separated from the lock and may be easily lost, it is therefore inconvenient to serve as a luggage locking device.

2. When reclosing an open lock, the locking bolt 78 should be rotated by the key to deviate from the blocking means 82 when closing the latch member 30 to the base portion. Otherwise, the latch member 30 may be obstructed by the blocking means 82 to influence a closing operation such as a luggage cover and its case.

A conventional brief case may be provided with a combination latching device on its upper cover and lower case. However, when it is intended to close the upper cover on the lower case the combination should be set to its opening state. Otherwise, a hasp secured on a upper cover may be obstructed by a latching means at its locking position in the lower case, thereby causing an inconvenient closing operation.

The present inventor has found the drawbacks of the conventional locks used in a luggage or the like and invented the present combination locking device which can be fastened at random.

SUMMARY OF THE INVENTION

The object of the present invention is to provide a combination locking device having a locking base secured on a first fixing member such as a lower case portion of a luggage, and a hasping cover secured on a second fixing member such as an upper cover of the luggage cooperable with the first fixing member, the hasping cover being always fastened by a latching tongue resiliently held in the locking base, regardless of a locking or unlocking situation of the locking base, thereby ensuring the upper cover to be always fastened by the lower case portion.

Another object of the present invention is to provide a combination locking device on a luggage or a case wherein a slide member is slidably retained in the locking base and is depressible to release the latching tongue to open the hasping cover from the locking base in an easy way.

DETAILED DESCRIPTION

As shown in the figures (especially FIG. 8), the present invention comprises: a locking base means 100 secured on a first fixing member T1 of a case, a luggage or a container T; and a hasping cover means 800 secured on a second fixing member T2 of the case T.

Figure 1:
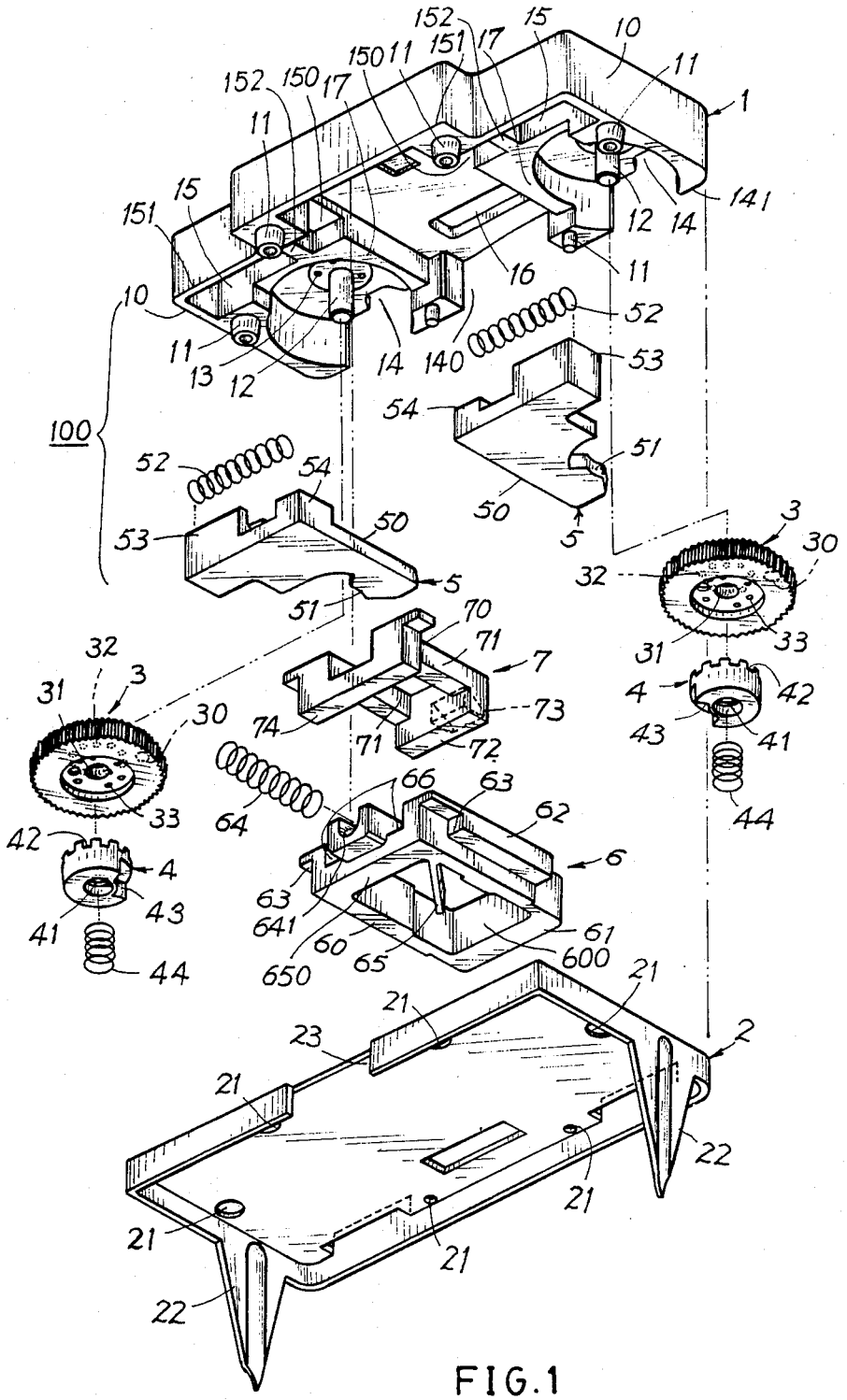
FIG. 1 is an illustration showing all elements constructing a locking base of the present invention when viewed from a rear bottom side thereof.

The locking base means 100 as shown in FIG. 1 includes: a base housing 1, a first bottom plate 2 combinable with the housing 1, a plurality of dials 3, a plurality of sleeves 4, a plurality of sleeve couplers 5, a slide member 6, and a latching tongue member 7. The number of the dials 3, the sleeves 4 and the couplers 5 are two as shown in the drawings.

The base housing 1 includes: a plurality of stems 11 protruding downwardly from the housing to engage a plurality of holes 21 of the bottom plate 2, a plurality of pivots 12 formed on the housing 1 for pivotally mounting the dials 3 near a front edge portion 141 of the housing 1, a plurality of notches 14 formed in the front edge portion 141 for revealing the numerals 30 formed on the dials 3, a plurality of central transverse grooves 150 each formed in a side portion of the housing near a rear edge portion 151, a plurality of spring sockets 15 each formed proximate to a side wall 10 and the rear edge portion 151 of the housing 1 separated from the central transverse groove 150 with a partition plate 152, and a hasp slot 16 formed in a front portion of the housing 1. Each pivot 12 is radially disposed around by a plurality of protrusions 13 formed on the housing 1.

Figure 6:
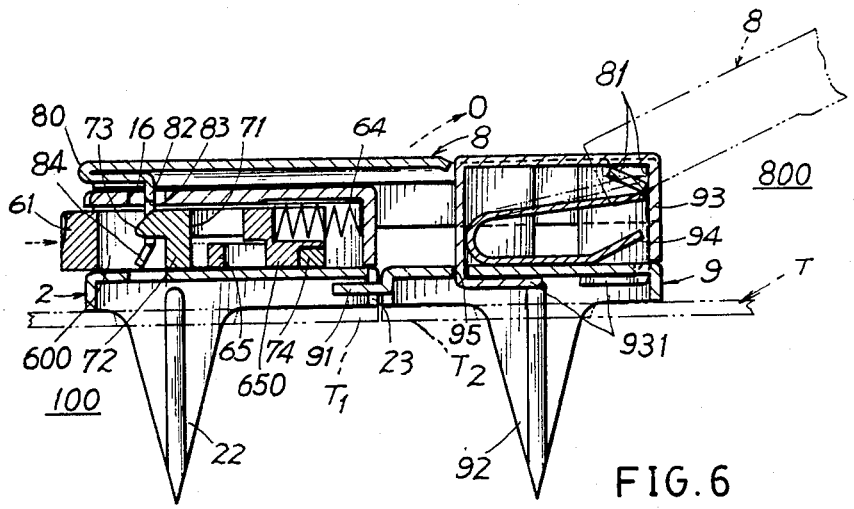
FIG. 6 is a sectional drawing of the present invention when viewed from II—II direction of FIG. 4.
Figure 7:
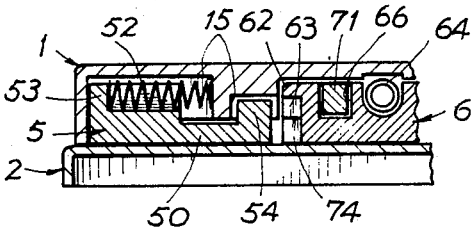
FIG. 7 is a sectional drawing of the present invention when viewed from III—III direction of FIG. 3.

The first bottom plate 2 includes a plurality of tabs 22 protruding downwardly for moutning the plate 2 on a first fixing member T1 as shown in FIG. 6, a rear slot 23 formed in a rear edge engageable with a positioning tang 91 formed on the hasping cover means 800, and a plurality of holes 21 engaged with the stems 11 for combining the base housing 1.

Each dial 3 is formed on a central hole 31 fo pivotally mounting the dial 3 on each pivot 12, a plurality of recesses formed in an upper surface thereof engageable with the portrusions 13 formed on the housing 1, and a plurality of protrusions 33 formed on a lower surface thereof radially disposed around the hole 31.

Each sleeve 4 includes a plurality of grooves 42 rotatably engageable with the plural protrusions 33 of each dial 3 as tensioned by a spring 44 retained between the sleeve and the bottom plate 2, a central hole 41 for pivotally mounting the sleeve 4 on the pivot 12, and a divergent notch 43 diverging radially formed in the sleeve.

Each sleeve coupler 5 generally formed as a flat plate 50 includes: a taper extension 51 formed on a front portion of the plate 50 engageable with the divergent notch 43 of the sleeve 4, a locking block 54 fromed on a rear portion of the plate 50 slidably engageable with the central transverse groove 150, and a spring 52 retained in a spring holder 53 formed on a side portion aside the locking block 54 normally tensioning the holder 53 and the sleeve coupler 5 towards the side wall 10 to operatively engage the taper extension 51 with the notch 43 of the sleeve 4. The spring 52 is also retained against the partition plate 152.

The slide member 6, generally formed as a rectangular hollow frame 60 slidable in between two sliding extensions 17 longitudinally formed in a central portion of the base housing 1, includes: a push-button portion 61 formed on a front end of the frame 60 protruding outwardly through a button opening formed in the front edge 141 of housing 1, two longitudinal extensions 62 formed on two side portions of the frame 60 each extension 62 having a recess portion 63 recessed in a rear end of the extension 62 engageable with the locking block 54 of the sleeve coupler 5, a spring plate 65 inclinedly formed in a frame opening 600 defined within the frame 60 and protruding from a rear end plate 650 of the frame 60, a restoring spring 64 held in a spring socket 641 formed on the rear end plate 650 normally tensioning the slide member 6 to protrude the push-button portion 61 outwardly against the rear edge portion 151 of the housing 1, and two sliding grooves 66 longitudinally formed in the rear end plate 650 of the frame 60. The push-button portion 61 may be formed as a recess portion as shown in FIGS. 8, 9 for an easy depression by an operator's finger.

The latching tongue member 7, generally formed as a rectangular frame 70 smaller than the frame 60 of the slide member 6, includes two longitudinal arm members 71 slidably engageable with the two sliding grooves 66 in the slide member 6, a front end plate 72 secured between the two arm members 71 on a front portion of the frame 70 positioned beyond the spring plate 65, a latching tongue 73 tapered frontwardly and downwardly formed on a front end of the front plate 72 movably confined in the frame opening 600, and a rear end plate 74 formed on a rear end of the frame 70 between the two arm members 71 positioned after the rear end plate 650 of the slide members 6. The rear end plate 74 is formed as an U shape without obstructng the spring socket 641 of the slide member 6.

Figure 2:
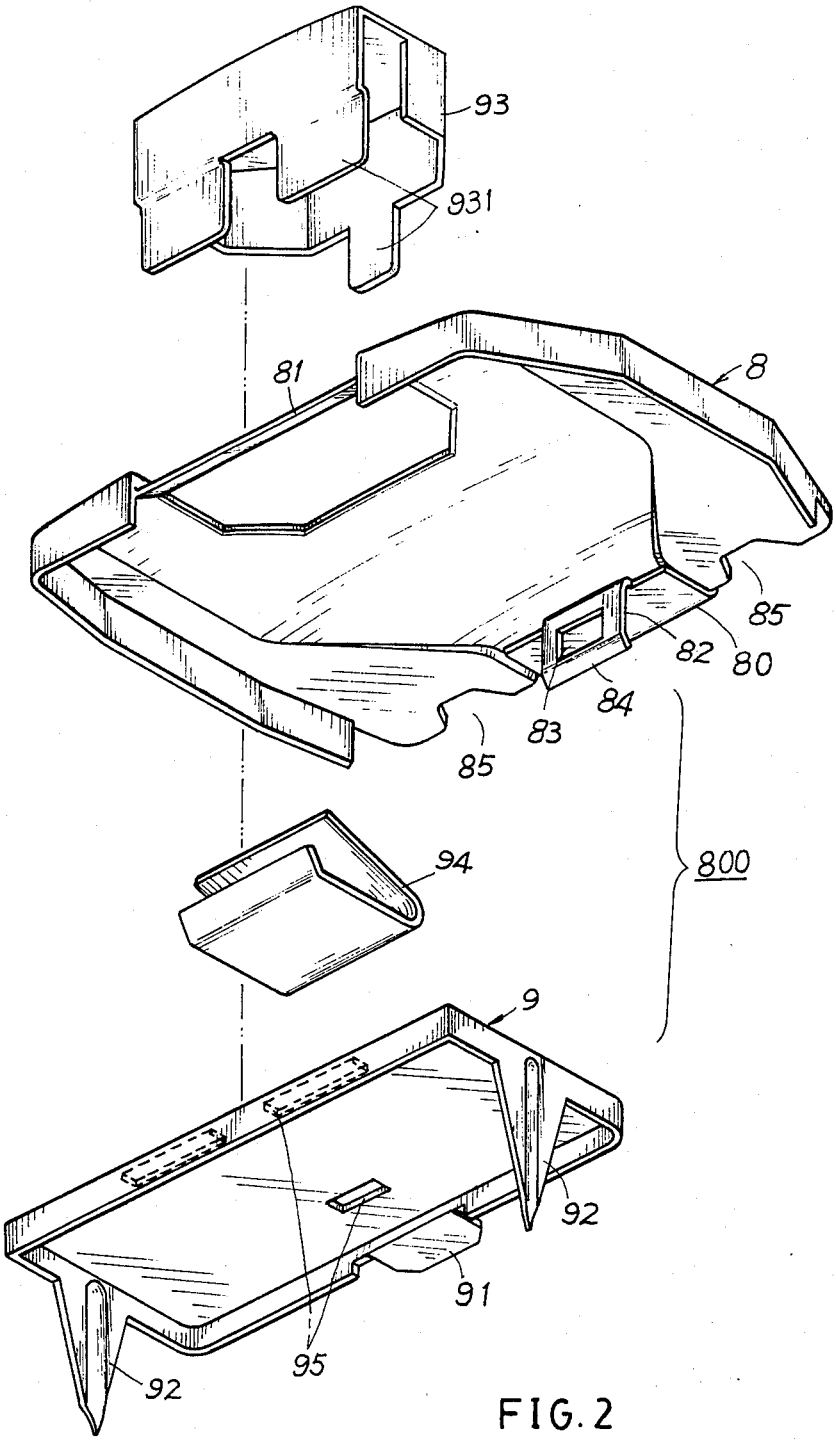
FIG. 2 is an illustration showing all elements of a hasping cover of the present invention when viewed from a rear bottom side thereof.
Figure 3:
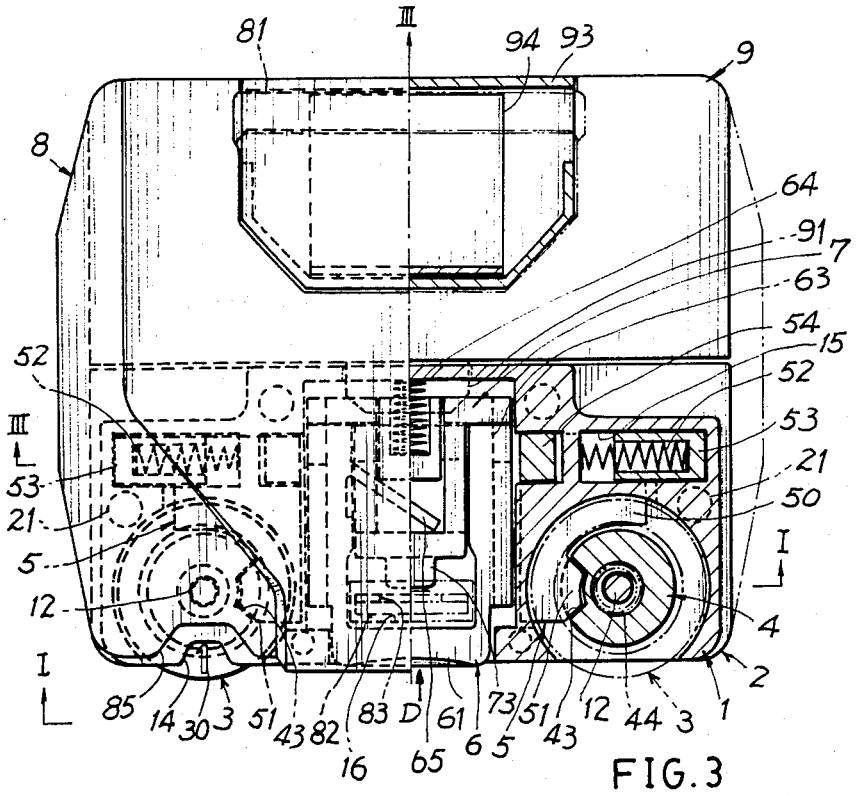
FIG. 3 is a top-view illustration showing a partial sectional drawing of the present invention when opened.
Figure 8:
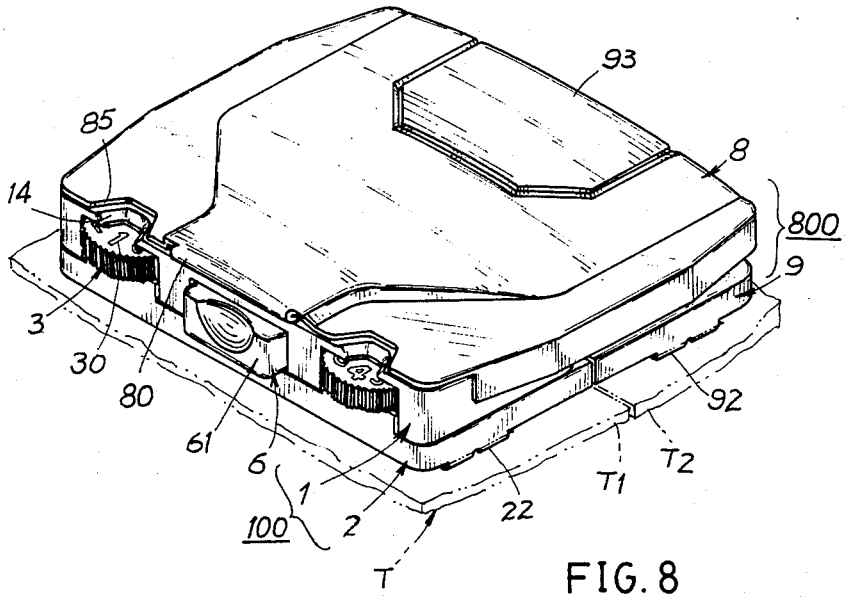
FIG. 8 is a perspective view of the present invention when assembled.
Figure 9:
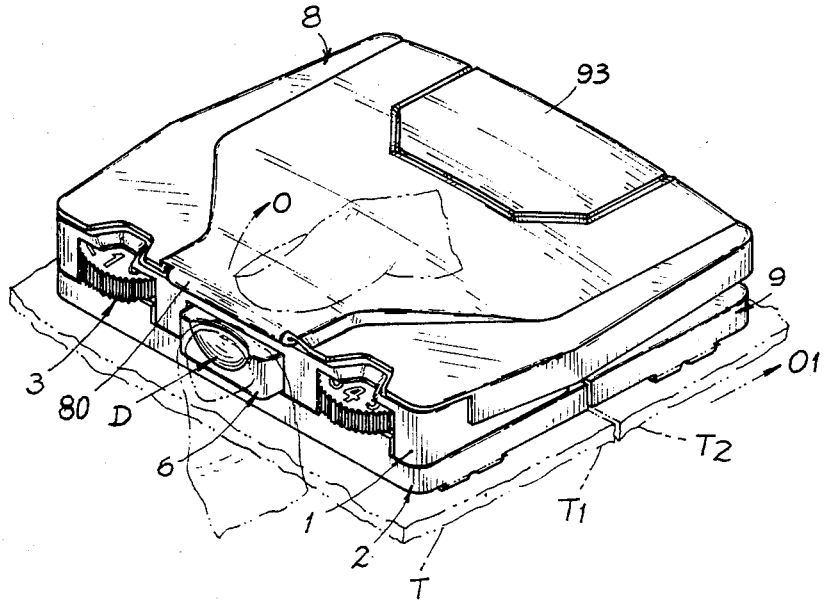
FIG. 9 shows an opening operation of the present invention.

The hasping cover means 800 as shown in FIGS. 2, 6, and 8 includes: a second bottom plate 9 having a plurality of tabs 92 protruding downwardly for mounting the plate 9 on a second fixing member T2 of a luggage or a case T and having a positioning tang 91 operatively engageable with the slot 23 formed in the first bottom plate 2 for first matching the upper cover with the lower base for ther aligned locking, and an upper cover 8 having a rear hinge plate 81 pivotally secured to the second bottom plate 9 and resiliently retained by a spring plate 94 held in a spring box 93 having tabs 931 secured in the slits 95 in the bottom plate 9.

The upper cover 8 has an area generally equal to an area of the first bottom plate 2 plus an area of the second bottom plate 9 for shielding the two bottom plates 2, 9 when fastening the upper cover 8 on the locking base 100. The upper cover 8 is formed a hasp member 82 on its front portion which is formed a tongue slot 83 engageable with the latching tongue 73 of the latching tongue member 7 and formed with a sloping plate 84 inclined downwardly and frontwardly for tangentially depressing the tongue 73 tapered frontwardly and downwardly when closing the cover 8 on the locking base means 100 as shown in FIG. 6. The upper cover 8 is formed with a plurality of notches 85 on a front edge thereof for revealing the numerals 30 of the dials 3. The spring plate 94 will resiliently bias the upper cover 8 for its quick opening as shown in dotted line of FIG. 6.

The upper cover 8 has the front edge projectively positioned beyond the depressed push-button portion 61 for easily opening the upper cover.

Figure 4:
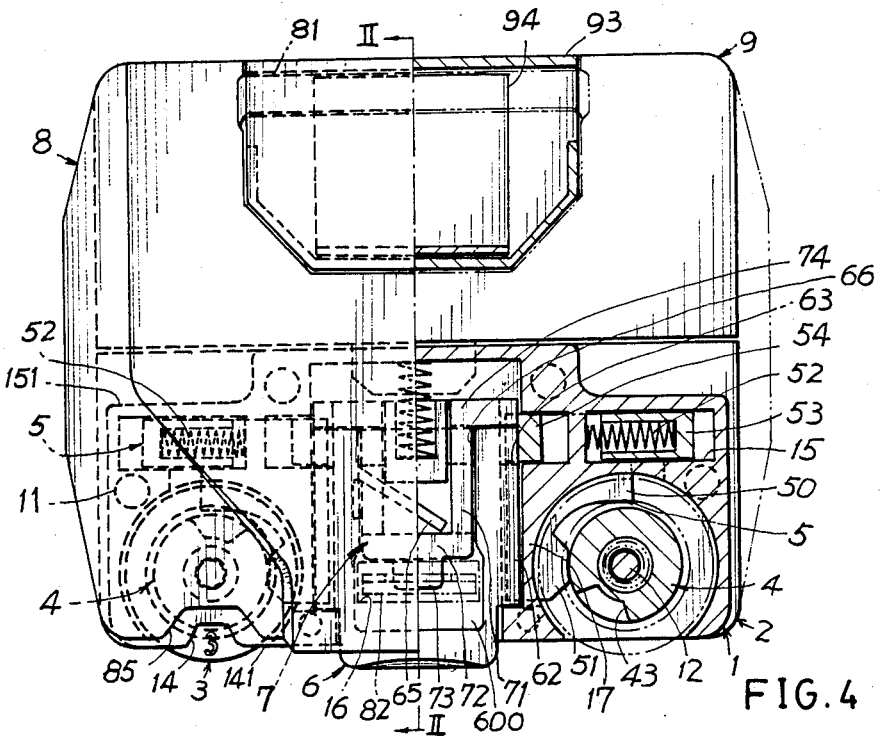
FIG. 4 is an illustration of the present invention when locked.
Figure 5:
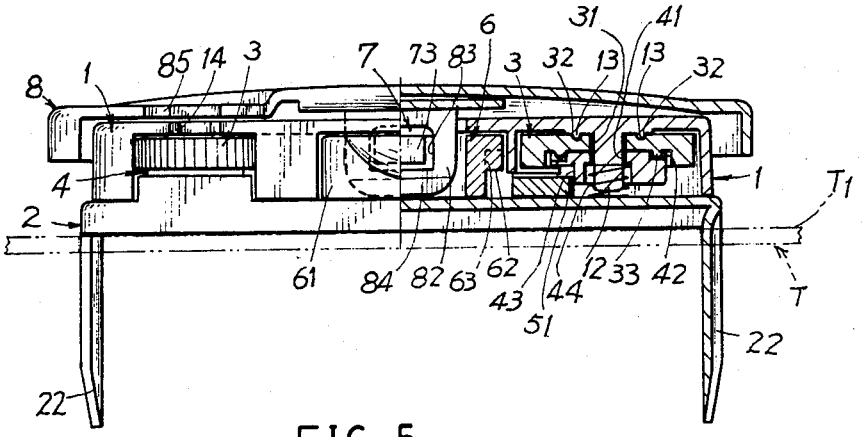
FIG. 5 is a sectional drawing of the present invention when viewed from I—I direction of FIG. 3.

When locking the present invention as shown in FIGS. 4 and 6, the dials 3 and sleeves 4 are rotated to a locking condition to alow the divergent notch 43 of the sleeve 4 to thrust the taper extension 51 of the sleeve coupler 5 in a direction opposite to the side wall 11 of housing 1 to move the locking block 54 to engage the recess portion 63 of the slide member 6, thereby obstructing the depression of the push-button portion 61 of the slide member 6. The latching tongue 73, as not retracted by the push-button portion 61, will still engage the slot 83 of the hasp member 82 to fasten the upper cover 8 for locking the present lock.

For opening the lock of the present invention from FIG. 4 to FIGS. 3, 5 and 7, the dials and sleeves are rotated to an opening situation to allow the taper extension 51 of the sleeve coupler 5 to engage the notch 43 of the sleeve 4 to retract the locking block 54, as tensioned towards the side wall 11 by the spring 52, to disengage the block 54 from the recess portion 63, so that upon a depression of the push-button portion 61 rearwardly the frame 70 is retracted to push the rear end plate 74 of the latching tongue member 7 to retract the tongue 73 so as to disengage the tongue 73 from the hasp member 82, and upon a holding of the front edge of the upper cover 8 by an operator's fingers as shown in FIG. 9, the cover is lifted (direction 0) to open the second member T2 such as a luggage cover (direction 01) from the first member T1 such as a luggage case portion.

For resetting a new combination of the present invention, the push-button portion 61 is continuously depressed to allow the side longitudinal extension 62 of the slide member 6 to retard the blocks 54 of the sleeve couplers 5 to engage the taper extensions 51 with the sleeve notches 43 so that the dials 3 can be free rotated for changing a new combination.

Even the slide member 6 is locked as shown in FIG. 4, the upper cover 8 may still be closed on the locking base 100 since the downward movement of the hasp member 82 may retract the tongue 73 which is tensioned by the inclined spring plate 65 in the opening 600 to re-engage the tongue 73 with the slot 83.

The present invention is superior to a conventional lock used in a luggage with the following advantages:

1. No matter whether the combination dials 3 are in opening or closing combinations, the upper cover 8 may always be closed on the locking base 100 for quickly fastening the upper cover 8 and the second member T2 with the lower base means 100 and the lower first member T1. This is especially helpful for a hurry check-in, check-out procedures in airport or hotel counters.

2. The depression of the slide member 6 and the upward opening of the cover 8 almost become an one-step operation reviewing the illustration of FIG. 9 for quick opening of a lock. No key is required for such a combination lock.

3. The upper hasp and lower base are formed as a simple compact structure, eliminating the so many conventional separable members or parts (for example, the loop 32, the latch 30, the hasp B, the arms 50 of U.S. Pat. No. 3,584,906) for improving an esthetic effect of the present invention.

I claim:

1. A combination locking device comprising:

a locking base means secured on a first fixing member of a case portion, and a hasping cover means secured on a second fixing member of a case cover combinable with said case portion for forming a case, a container or a luggage; the locking base means including:

a first bottom plate secured to said first fixing member;

a base housing combinable with the first bottom plate having a hasp slot formed in said housing;

a plurality of combination dials pivotally mounted in said housings;

a plurality of sleeves resiliently engageable with the dials, each said sleeve having a divergent notch diverging radially formed in said sleeve;

a plurality of sleeve couplers each having a taper extension engageable with each said divergent notch of said sleeve and having a locking block formed thereon;

a slide member resiliently formed in a central portion of said housing having at least a recess portion engageable with said locking block of said sleeve coupler for locking the slide member; and a latching tongue member slidably retained in said slide member and having a latching tongue formed on its front portion operatively depressible by said slide member; and the hasping cover means including: a second bottom plate secured to the second fixing member and an upper cover pivotally secured to said second bottom plate, having a hasp member formed with a tongue slot therein engageable with and fastened by the latching tongue of the locking base means when poking through the hasp slot in said housing, whereby upon a rotation of the dials and sleeves to an opening combination to engage the sleeve notches with the coupler extensions to disengage the locking blocks from the recess portions of the slide member, the slide member is depressed to retract the latching tongue to unlock the upper cover from the locking base means, and upon a rotation towards a locking state to disengage the coupler extensions from the sleeve notches to allow the locking blocks to engage the recess portions of the slide member, the slide member can not be depressed, thereby locking the upper cover on the base means.

2. A combination locking device according to claim 1, wherein said hasp member of said upper cover is formed a tongue slot therein engageable with said latching tongue, and a sloping plate on a lower end of the hasp member inclined downwardly and frontwardly towards a front end of said slide member.

3. A combination locking device according to claim 1, wherein said sleeve coupler has the locking block formed on a rear edge of a flat plate of the coupler slidably formed in a central transverse groove formed in the base housing for operatively engaging the recess portion formed in a side portion of said slide member, and a spring retained in a spring socket of said coupler movably formed in said housing normally tensioning said coupler towards a side wall of said housing for operatively engaging the taper extension of said coupler with said divergent notch of said sleeve.

4. A combination locking device according to claim 1, wherein said slide member is generally formed as a rectangular hollow frame having a push-button portion formed on a front end of said frame normally protruding outwardly through an opening formed in said housing, a spring plate inclinedly protruding from a rear end plate of the hollow frame and confined within a frame opening, and a restoring spring retained between the rear end plate of the hollow frame and a rear edge portion of said housing for resiliently tensioning said slide member and said push-button portion outwardly.

5. A combination locking device according to claim 1, wherein said latching tongue member includes a pair of longitudinal arm members slidably engageable with two sliding grooves formed in said slide member, a front end plate securing two front ends of the arm members having the latching tongue protruding frontwardly from the front end plate and movably defined within the frame opening of the slide member and operatively resiliently tensioned by the spring plate inclinedly protruding from the rear end plate of the slide member, and a second rear end plate securing two rear ends of the two arm members, positioned after the rear end plate of said slide member and operatively retracted by the rear end plate of the slide member upon a drepression of the push-button portion of the slide member to disengage the tongue from the hasp member of the upper cover for opening the upper cover.

6. A combination locking device according to claim 5, wherein said latching tongue is tapered frontwardly and downwardly towards a front end of said slide member to be tangentially depressed by said sloping plate of said hasp member of the upper cover, upon a closing movement of the upper cover on said locking base means.

7. A combination locking device according to claim 1, wherein said upper cover has a surface area generally equal to a surface area of the base housing plus a surface area of the second bottom plate for shielding the locking base means and the second bottom plate when locked.

8. A combination locking device according to claim 1, wherein said second bottom plate of said hasping cover means has a positioning tang protruding outwardly from the second bottom plate to operatively engage a tang slot formed in an edge portion of said first bottom plate for first matching the hasping cover means with the locking base means for their aligned locking.

9. A combination locking device according to claim 1, wherein said slide member is resiliently slidably defined between a pair of sliding extensions longitudinally formed in said base housing.

10. A combination locking device according to claim 5, wherein said latching tongue and said front end plate of the latching tongue member is movably confined within the frame opening of said slide member in front of said spring plate inclinedly protruding from a rear end plate of said slide member into said frame opening, operatively engageable with said tongue slot of said hasp member which is poked into the frame opening of the slide member when closing the upper cover on said base housing.

11. A combination locking device according to claim 4, wherein said slide member has said recess portion recessed in a longitudinal extension formed on a side portion of said slide member.

12. A combination locking device according to claim 4, wherein said push-button portion is formed a recess portion therein for an operator's depression.

13. A combination locking device according to claim 1, wherein said upper cover has a front edge protruding outwardly to position above said push-button portion and projectively protruding beyond the push-button portion when depressed for easily opening the lock when opening the upper cover from its locking position as closed on the locking base means.

14. A combination locking device according to claim 1, wherein said upper cover and said base housing are each formed with a plurality of notches for showing dial numerals.

* * * * *